US009673529B2

(12) United States Patent
Han et al.

(10) Patent No.: US 9,673,529 B2
(45) Date of Patent: Jun. 6, 2017

(54) ISM BAND ANTENNA STRUCTURE FOR SECURITY SYSTEM

(71) Applicant: UTC FIRE & SECURITY AMERICAS CORPORATION, INC., Bradenton, FL (US)

(72) Inventors: Dongmei Han, Shoreview, MN (US); Rene Christian, Brookfield, WI (US)

(73) Assignee: UTC FIRE & SECURITY AMERICAS CORPORATION, INC, Bradenton, FL (US)

( * ) Notice: Subject to any disclaimer, the term of this patent is extended or adjusted under 35 U.S.C. 154(b) by 104 days.

(21) Appl. No.: 14/417,922

(22) PCT Filed: May 28, 2013

(86) PCT No.: PCT/US2013/042806
§ 371 (c)(1),
(2) Date: Jan. 28, 2015

(87) PCT Pub. No.: WO2014/021977
PCT Pub. Date: Feb. 6, 2014

(65) Prior Publication Data

US 2015/0214623 A1 Jul. 30, 2015

Related U.S. Application Data

(60) Provisional application No. 61/677,268, filed on Jul. 30, 2012.

(51) Int. Cl.
*H01Q 9/04* (2006.01)
*H01Q 1/12* (2006.01)
(Continued)

(52) U.S. Cl.
CPC ..... *H01Q 9/045* (2013.01); *H01Q 1/007* (2013.01); *H01Q 1/12* (2013.01); *H01Q 1/1221* (2013.01);
(Continued)

(58) Field of Classification Search
CPC ..... H01Q 9/045; H01Q 9/0421
See application file for complete search history.

(56) References Cited

U.S. PATENT DOCUMENTS 6,342,860 B1 1/2002 Haussler et al.
6,380,903 B1 4/2002 Hayes et al.
(Continued)

OTHER PUBLICATIONS

International Search Report dated Oct. 21, 2013 corresponding to PCT/US2013/042806.
(Continued)

*Primary Examiner* — Hoang Nguyen
*Assistant Examiner* — Michael Bouizza
(74) *Attorney, Agent, or Firm* — Cantor Colburn LLP

(57) ABSTRACT

An antenna (10) is provided including a generally rectangular ground element (20) having a first end and a second end. The ground element (20) includes at least one hole (30, 30') for mounting the antenna to a support structure. A generally rectangular radiating element (12) having a third end and a fourth end if parallel to the ground element (20) and separated from the ground element (20) by a space. A bend connects the first end of the ground element (20) to the third end of the radiating element (12). A coaxial cable includes a center conductor coupled to the radiating element (12) at a feed point and an outer conductor coupled to the ground element (20). The coaxial cable acts as a feed line that couples the antenna (10) to an external transmitter or receiver.

17 Claims, 4 Drawing Sheets

(51) Int. Cl.
*H01Q 1/48* (2006.01)
*H01Q 1/00* (2006.01)
*H01Q 1/22* (2006.01)

(52) U.S. Cl.
CPC ..... *H01Q 1/2291* (2013.01); *H01Q 1/48* (2013.01); *H01Q 9/0421* (2013.01); *Y10T 29/49016* (2015.01)

(56) References Cited

U.S. PATENT DOCUMENTS

| | | | |
|---|---|---|---|
| 6,486,834 | B2 | 11/2002 | Tsai |
| 6,556,169 | B1 | 4/2003 | Fukuura et al. |
| 6,714,162 | B1 | 3/2004 | Kadambi et al. |
| 6,914,568 | B2 | 7/2005 | Stoiljkovic et al. |
| 6,946,996 | B2 | 9/2005 | Koyama |
| 7,015,863 | B2 | 3/2006 | Sadler et al. |
| 7,030,816 | B2 | 4/2006 | Dai et al. |
| 7,181,258 | B2 | 2/2007 | Lin et al. |
| 7,193,580 | B2 | 3/2007 | Deng et al. |
| 7,982,682 | B2 | 7/2011 | Lee et al. |
| 2002/0171588 | A1 | 11/2002 | Fang |
| 2003/0095071 | A1 | 5/2003 | Skrivervik et al. |
| 2010/0309086 | A1 | 12/2010 | Jiang et al. |
| 2011/0025575 | A1 | 2/2011 | Niederkorn et al. |
| 2011/0043426 | A1 | 2/2011 | Lee |
| 2011/0201288 | A1 | 8/2011 | Hooper et al. |

OTHER PUBLICATIONS

Written Opinion for International application No. PCT/US2013/042806, date of mailing Oct. 21, 2013, 9 pages.

ISM BAND ANTENNA STRUCTURE FOR SECURITY SYSTEM

BACKGROUND OF THE INVENTION

The invention relates generally to antennas, and more particularly to antennas used with an interactive services module (ISM).

A planar inverted F antenna (PIFA) typically includes multiple layers of rigid materials formed together to provide a radiating element having a conductive path therein. The various layers and components of a PIFA are typically mounted directly on a molded plastic or sheet metal support structure.

An interactive services module (ISM), commonly includes a network device and a support structure surrounding the periphery of the network device. A PIFA is mounted to the surface of a support structure using tape or adhesive such that the PIFA is capacitively coupled to the exterior of the network device. When the PIFA is mounted with tape or adhesive, contaminants may become trapped between the antenna and support structure, thereby affecting the signal transfer between the antenna and the network device. Also, the durability of the tape or adhesive is limited such that the antenna may move relative to the support structure.

BRIEF DESCRIPTION OF THE INVENTION

According to one embodiment of the invention, an antenna is provided including a generally rectangular ground element having a first end and a second end. The ground element includes at least one hold for mounting the antenna to a support structure. A generally rectangular radiating element having a third end and a fourth end if parallel to the ground element and separated from the ground element by a space. A bend connects the first end of the ground element to the third end of the radiating element. A coaxial cable includes a center conductor coupled to the radiating element at a feed point and an outer conductor coupled to the ground element. The coaxial cable acts as a feed line that couples the antenna to an external transmitter or receiver.

According to another aspect of the invention, an interactive services module is provided including a network device surrounded at least partially by a support structure. The support structure includes a mounting surface having at least one tab extending generally perpendicularly therefrom. A ground element of an antenna is in direct contact with the mounting surface. The ground element includes at least one hole. The at least one tab extends through the hole and is bent to restrict movement of the antenna relative to the mounting surface.

According to yet another embodiment, a method for mounting an antenna having a ground element including at least one hole to a mounting surface of a support structure is provided. The mounting structure has at least one tab extending perpendicularly therefrom. The at least one hold and the at least one tab are aligned. The at least one tab is inserted into the at least one hole. The antenna is then moved relative to the at least one tab until the ground element is in direct contact with the mounting surface. The at least one tab is then bent to restrict movement of the antenna relative to the mounting surface.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
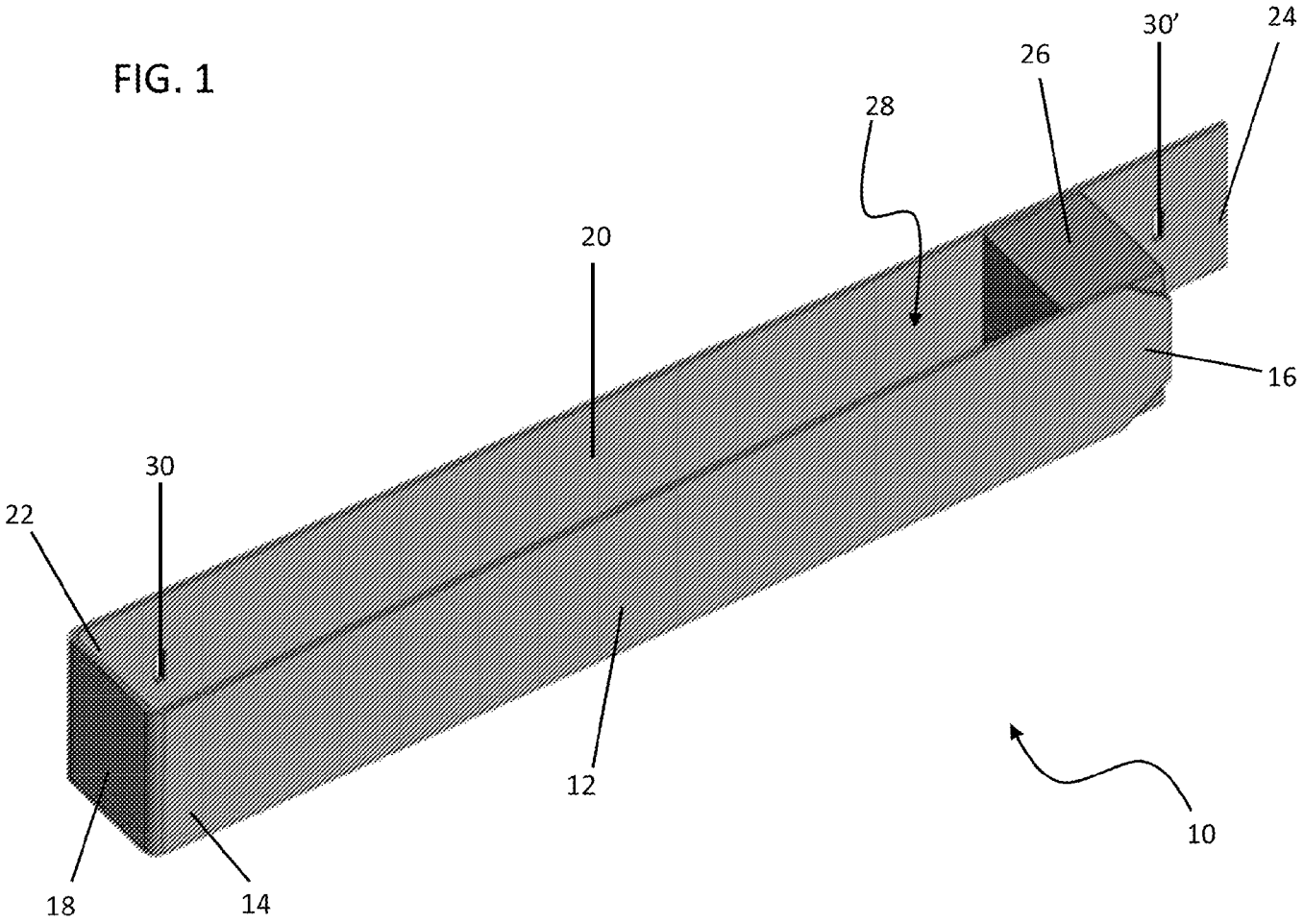
FIG. 1 is a perspective view of an antenna according to an embodiment of the invention.

Referring to FIG. 1, an antenna 10 for use in an interactive services module (ISM) 200 is illustrated. In one embodiment, the antenna 10 is a planar inverted F antenna (PIFA). The antenna 10 includes a generally rectangular radiating element 12 maintained in a generally parallel, spaced apart relationship with a generally rectangular ground element 20. A first end 14 of the radiating element 12 is connected to a first end 22 of the ground element 20 by a connector 18. A sponge 26 may be positioned between the second end 16 of the radiating element 12 and a respective portion of the ground element 20 to maintain the radiating element 12 and the ground element 20 in a parallel orientation. In one embodiment, the radiating element 12 and the ground element 20 may be formed separately and then coupled with the connector 18. Alternatively, the radiating element 12, the connector 18, and the ground element 20 may be formed integrally by bending a material into a selected shape. The antenna 10 may be tuned to a desired frequency by varying the length L of the radiating element 12, by varying the gap H between the radiating element 12 and the ground element 20, by adjusting the feed point of the antenna, or by modifying other known parameters that affect the gain and bandwidth of the antenna 10.

Figure 2:
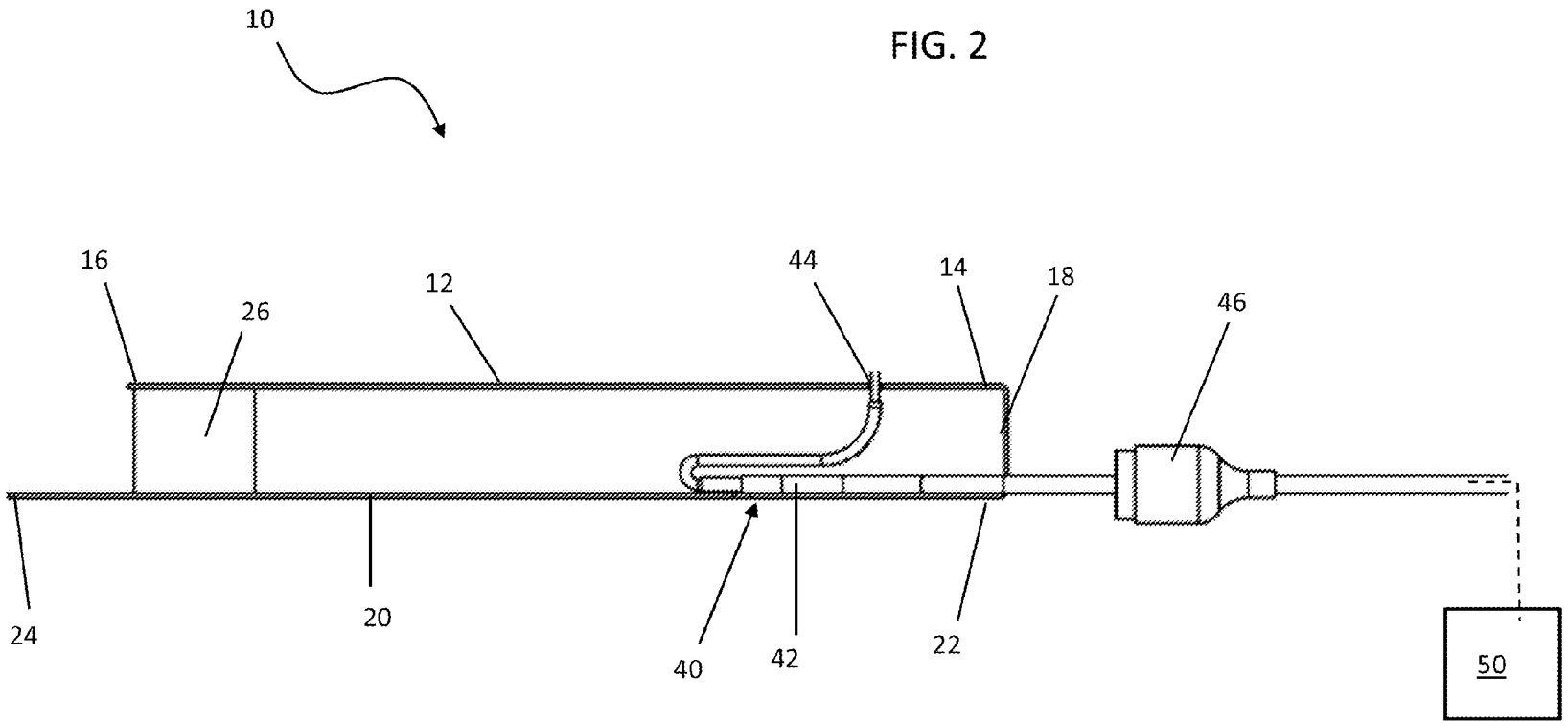
FIG. 2 is a side view of an antenna according to an embodiment of the invention.

The radiating element 12 is generally shorter than the ground element 20. In one embodiment, illustrated in FIG. 2, a coaxial cable 40 having an outer conductor 42 and a center conductor 44 is coupled to the antenna 10 between the sponge 26 and the connector 18. The center conductor 44 connects to the radiating element 12 at a feed point such that the coaxial cable 40 forms a feed line to couple the radiating element 12 to an external transmitter and/or receiver 50. The outer conductor 42 of the coaxial cable 44 may be connected to the ground element 20 to form a shunt inductor that maximizes power transfer between the antenna 10 and the coaxial cable 40. In one embodiment, the coaxial cable 40 includes a ferrite bead 46. The ferrite bead 46 attenuates all radio frequencies transmitted and received above a desired frequency threshold.

Figure 3:
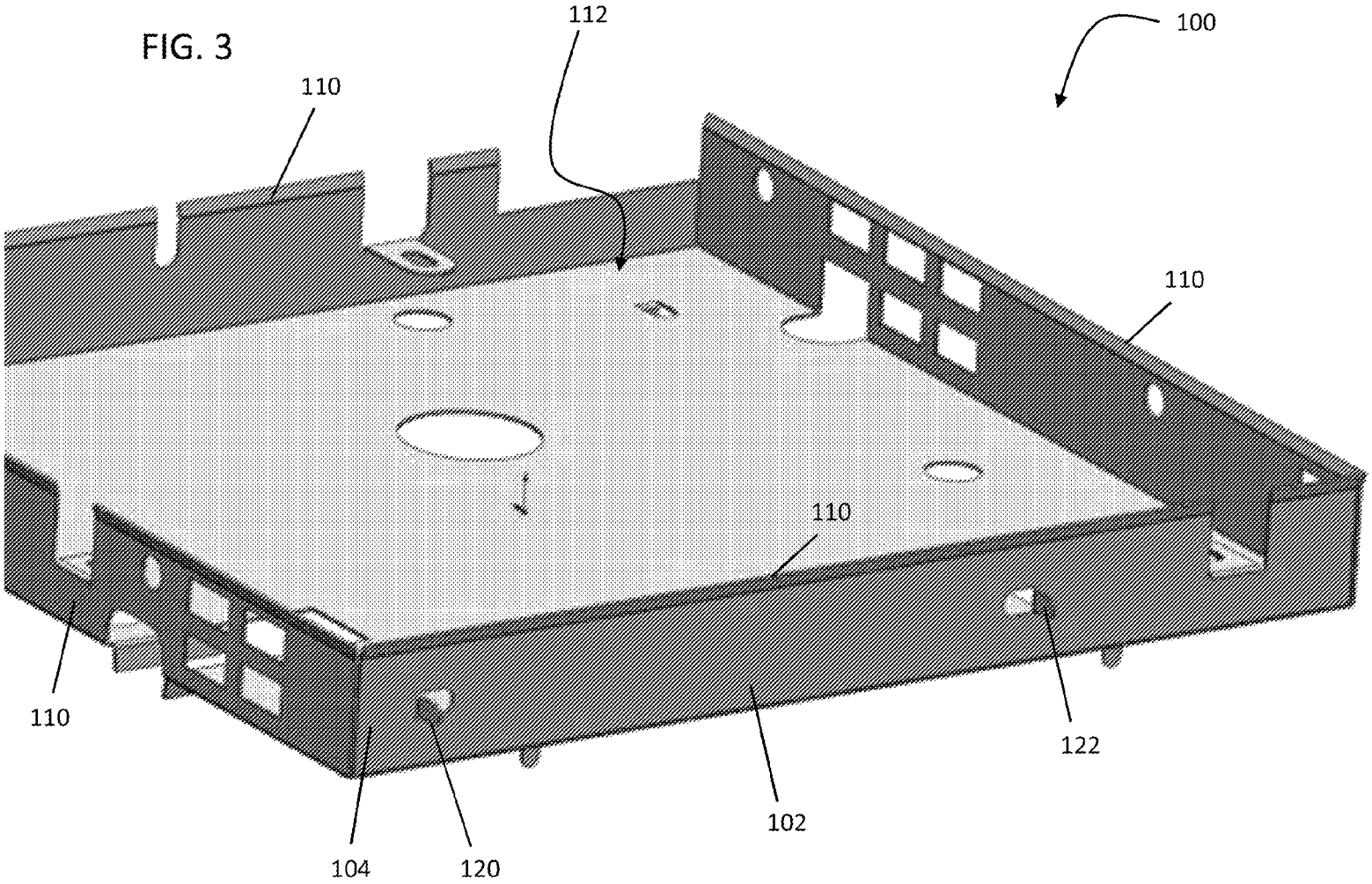
FIG. 3 is a perspective view of a support structure according to an embodiment of the invention.

The ground element 20 includes at least one hole 30 for mounting the antenna 10 to a support structure 100 (see FIG. 3). In one embodiment, the ground element 20 includes a first hole 30 near the first end 22 and the connector 18, and a second hole 30' adjacent the second, opposite end 24. The holes 30, 30' may be formed in the ground element 20 by some manufacturing process, such as punching or machining for example, either before or after the antenna 10 is fabricated. The antenna 10 may be used for any single band architecture, including but not limited to a Z-wave network for example.

Referring now to FIG. 3, a support structure 100 to which the antenna 10 may be connected is illustrated. The support structure 100 includes a mounting surface 102 complementary to a surface of the ground element 20. In one embodiment, the support structure 100 is a shield for a network device and includes a plurality of generally perpendicular walls 110. Mounting surface 102 may be an exterior surface of one of the plurality of walls 110 of the support structure 100. Also, the mounting surface 102 may be made from a conductive material, such as a metal for example. The plurality of walls 110 define an interior portion 112, such that a CAN bus or other network device may be located therein. At least one tab 120 extends generally perpendicularly from the mounting surface 102 of the support structure 100, for engagement with a corresponding hole 30 of the ground element 20 of the antenna 10. The tab 120 has a cross-section generally equal to or smaller than the size of the hole 30 so that the tab 120 may be inserted into and through the hole 30. In one embodiment, the number of tabs extending outwardly from the mounting surface 102 is equal to the number of holes 30 formed in the ground element 20 of the antenna 10. For example, the mounting surface 102 may include a first tab 120 positioned near a first end 104 of a wall 110 and a second tab 122 may be spaced a distance apart from the first tab 120 on the same wall 110. The distance between the first tab 120 and the second tab 122 on the mounting surface 102 may be equal to the distance between the first hole 30 and the second hole 30' of the ground element 20. In addition, the first tab 120 and the second tab 122 may be identical, or alternatively, may have cross-sections of a different size and shape.

Figure 4:
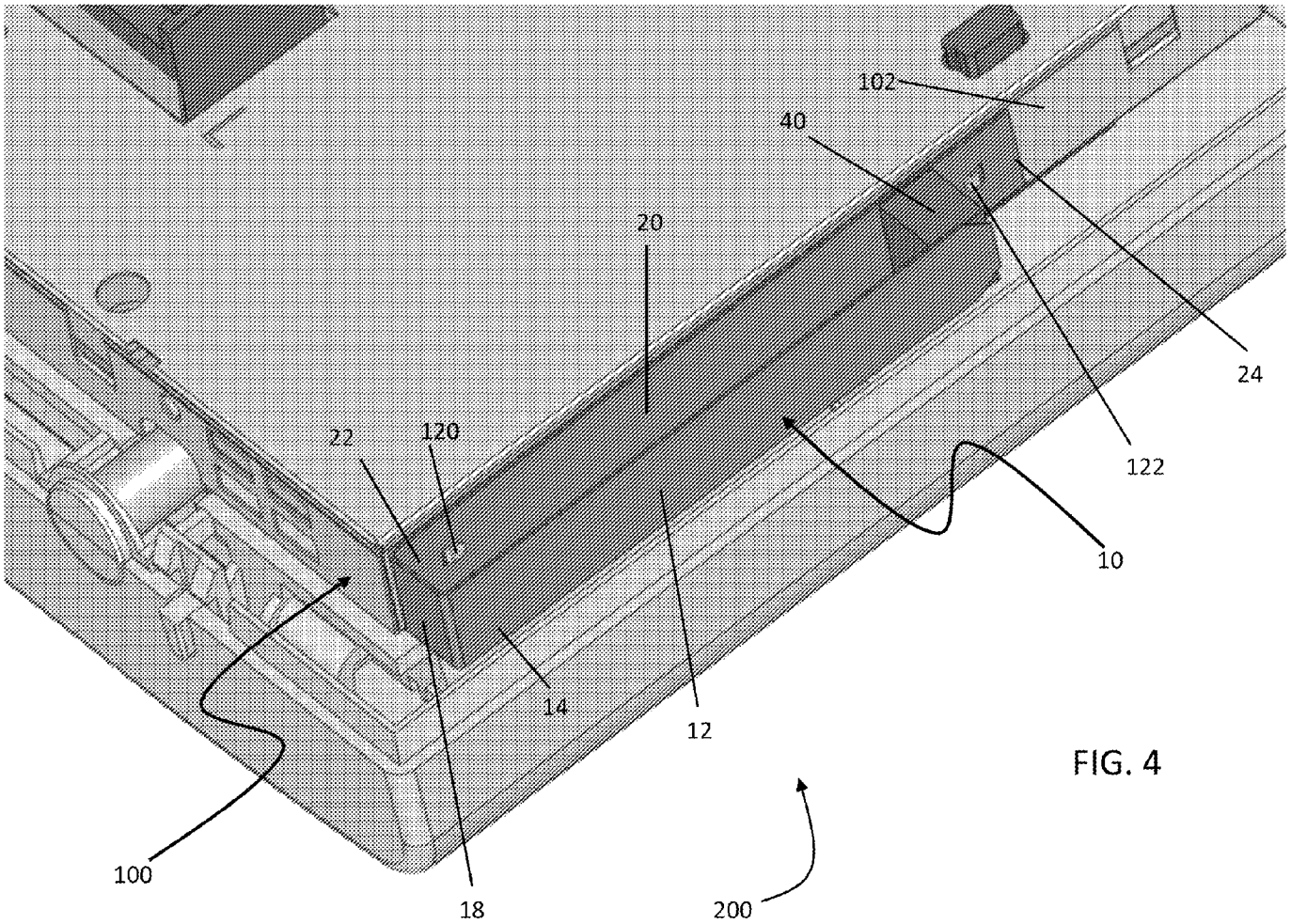
FIG. 4 is perspective view of an interactive services module according to an embodiment of the invention.

FIG. 4 illustrates an ISM 200 including an antenna 10 coupled to the mounting surface 102 of the support structure 100. To mount the antenna 10 to the support structure 100, each tab 120 of the mounting surface 102 is aligned with and inserted into a corresponding hole 30 on the ground element 20. For example, the first tab 120 is inserted into the first hole 30 and the second tab 122 is inserted into the second hole 30'. The ground element 20 is then moved relative to the tabs 120, 122 in the direction of the mounting surface 102 until a surface of the ground element 20 is in direct contact with the mounting surface 102. When moving the ground element 20 into contact with the support structure 100, the ferrite bead 46 should be retained in the interior 112 of the support structure 100, near the sidewall 102, to prevent the ferrite bead 46 from contacting the radiating element 12.

When the ground element 20 and the mounting surface 102 are engaged, the tabs 120, 122 will extend a distance beyond the ground element 20 into the space 28 between the ground element 20 and the radiating element 12. Each of the tabs 120, 122, that extends into the space 28, is then bent relative to the ground element 20. In one embodiment, each of the tabs 120, 122 is bent approximately 90 degrees to a position generally parallel to the ground element 20. The tabs 120, 122 may be bent during assembly either manually, such as with pliers for example, or automatically by a machine.

By bending the tabs 120, 122 parallel to the ground element 20, movement of the antenna 10 relative to the mounting surface 102 of the support structure 100 is restricted. The tabs 120, 122 retain the antenna 10 in direct contact with the mounting surface 102, thereby improving the radiation efficiency of currents induced from the antenna 10 to the ground outside the network device. Excited radio frequency currents on the ground element 20 can radiate outward therefrom, or alternatively, can radiate to the radiating element 12, through the coupled coaxial cable to the external transmitter and/or receiver 30. In addition, the process for mounting the antenna 10 to a support structure 100 is simplified and robust.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An antenna comprising:

a generally rectangular ground element having a first end and a second end, the ground element including at least one hole for mounting the antenna to a support structure;

a generally rectangular radiating element having a third end and a fourth end, the radiating element being generally parallel to the ground element and separated from the ground element by a space;

a bend connecting the first end of the ground element to the third end of the radiating element;

a sponge positioned between the radiating element and the ground element near the fourth end of the radiating element; and a coaxial cable having a center conductor coupled to the radiating element at a feed point and an outer conductor coupled to the ground element such that the coaxial cable acts as a feed line that couples the antenna to an external transmitter or receiver.

2. The antenna according to claim 1, wherein the radiating element, the bend, and the ground element are formed integrally.

3. The antenna according to claim 1, wherein the ground element includes a first hole adjacent the first end and a second hole adjacent the second end.

4. The antenna according to claim 1, wherein the ground element is configured to directly contact a support structure.

5. The antenna according to claim 1, wherein the antenna is configured for use with any single band architecture.

6. An interactive services module, comprising:

a network device;

a support structure surrounding a portion of the network device, wherein the support structure includes a mounting surface having at least one tab extending generally perpendicularly therefrom; and a ground element of an antenna is in direct contact with the mounting surface, the ground element including at least one hole such that the at least one tab extends through the at least one hole and is bent to restrict movement of the antenna relative to the mounting surface.

7. The interactive services module according to claim 6, wherein the mounting surface is made from a metallic material.

8. The interactive services module according to claim 6, wherein the support structure includes a plurality of walls arranged generally perpendicularly to one another to define an interior portion.

9. The interactive services module according to claim 8, wherein the network device is positioned within the interior portion.

10. The interactive services module according to claim 8, wherein the mounting surface is disposed on an exterior of one of the plurality of walls.

11. The interactive services module according to claim 6, wherein the mounting surface includes a first tab and a second tab and the antenna includes a first hole and a second hole.

12. The interactive services module according to claim 11, wherein a distance between the first tab and the second tab is generally equal to a distance between the first hole and the second hole.

13. The interactive services module according to claim 6, wherein the network device a Z-wave network.

14. A method for mounting an antenna having a ground element with at least one hole to a mounting surface of a support structure, the mounting surface having at least one tab extending generally perpendicularly therefrom, comprising:

aligning the at least one hole with the at least one tab;

inserting the at least one tab into the at least one hole;

moving the antenna relative to the at least one tab such that the ground element is in direct contact with the mounting surface; and bending the at least one tab to restrict movement of the antenna relative to the mounting surface.

15. The method according to claim 14, wherein the at least one tab is bent manually.

16. The method according to claim 14, wherein the at least one tab is bent automatically by a machine.

17. The method according to claim 14, wherein the antenna and the mounting surface have an equivalent number of holes and tabs.

* * * * *